US009192219B2

(12) United States Patent
Le et al.

(10) Patent No.: US 9,192,219 B2
(45) Date of Patent: Nov. 24, 2015

(54) WRIST REST APPARATUS

(71) Applicants: Nghiem Le, Caldwell, TX (US); Phuong Nguyen, Caldwell, TX (US)

(72) Inventors: Nghiem Le, Caldwell, TX (US); Phuong Nguyen, Caldwell, TX (US)

( * ) Notice: Subject to any disclaimer, the term of this patent is extended or adjusted under 35 U.S.C. 154(b) by 0 days.

(21) Appl. No.: 14/161,635

(22) Filed: Jan. 22, 2014

(65) Prior Publication Data

US 2015/0201731 A1 Jul. 23, 2015

(51) Int. Cl.

| | |
|---|---|
| ***A45D 29/00*** | (2006.01) |
| ***A45D 44/00*** | (2006.01) |
| ***B68G 5/00*** | (2006.01) |
| ***A45D 29/22*** | (2006.01) |
| ***A45D 44/02*** | (2006.01) |
| ***A47B 21/03*** | (2006.01) |

(52) U.S. Cl.

CPC ..... *A45D 29/22* (2013.01); *A45D 44/02* (2013.01); *A47B 21/0371* (2013.01); *A45D 29/00* (2013.01); *A47B 2200/0092* (2013.01)

(58) Field of Classification Search

CPC ..... A45D 44/02; A45D 44/04; A45D 29/18; A45D 29/22; A45D 29/00; A45D 29/004; A45D 44/10; A47B 21/0371; A47B 2021/0392; A47B 11/00; A47B 97/00; A47B 17/065; A47B 2200/0091; A47B 2200/0092; A47B 2200/0093; H01H 9/025; Y10S 248/918

USPC ..... 132/73, 73.5, 75.3, 333; 248/118, 248/118.1, 118.3, 118.5, 918; 400/715; 297/115, 116, 145, 411.2, 411.21, 297/411.35; 211/119.009, 119.011, 168, 211/170, 26.1; D28/61; 206/557, 562, 563, 206/564, 565; 482/44, 45, 46

See application file for complete search history.

(56) References Cited

U.S. PATENT DOCUMENTS

| | | | | | |
|---|---|---|---|---|---|
| 915,047 | A | * | 3/1909 | Smith | 248/118 |
| 1,376,280 | A | * | 4/1921 | James | 248/118 |
| 2,172,178 | A | * | 9/1939 | Rosenberg | 248/118 |
| D132,795 | S | * | 6/1942 | Sommers | D28/20 |
| 2,676,597 | A | * | 4/1954 | Colbert | 132/73 |
| 4,332,263 | A | | 6/1982 | Kitrell | |
| 4,524,789 | A | * | 6/1985 | Sazdanoff | 132/73 |
| 5,184,795 | A | | 2/1993 | Sexton | |
| 5,222,925 | A | * | 6/1993 | Maycock et al. | 482/44 |
| 5,370,346 | A | | 12/1994 | Long | |
| 5,472,161 | A | | 12/1995 | Krukovsky | |
| 5,722,622 | A | * | 3/1998 | Gustafson | 248/118 |
| 5,762,302 | A | * | 6/1998 | Myers | 248/118.5 |
| 5,765,790 | A | * | 6/1998 | Kuldvere | 248/118 |

(Continued)

OTHER PUBLICATIONS http://www.wristrestusa.com, dated 2014.*

*Primary Examiner* — Vanitha Elgart

(74) *Attorney, Agent, or Firm* — The Keys Law Firm PLLC

(57) ABSTRACT

A wrist rest apparatus for supporting a user's wrist while receiving a manicure and holding the user's hand in a desired manner for the manicure. The wrist rest apparatus comprises a top console rotatably attached to a bottom console. The top console and the bottom consoles are defined by a solid plastic, semi-circular member having centrally disposed apertures in corresponding locations. The top console and the bottom console are joined together through a swivel member which is configured to pass through and be retained in the apertures, providing an axis about which the top console can rotate relative to the bottom console. Rotating locking mechanisms are included to allow rotation to be limited, with the top console being fixed in a parallel orientation relative to the bottom console.

5 Claims, 2 Drawing Sheets

(56) References Cited

U.S. PATENT DOCUMENTS

| | | | | |
|---|---|---|---|---|
| 6,267,336 | B1 | 7/2001 | Ruckstadter | |
| 6,454,224 | B1 | 9/2002 | Nogueira | |
| RE38,369 | E | 12/2003 | Ruckstadter | |
| 6,698,697 | B1 | 3/2004 | Lucero | |
| 6,736,357 | B2 | 5/2004 | Venn | |
| 6,923,505 | B2 | 8/2005 | Siminovitch | |
| 2002/0130226 | A1* | 9/2002 | Nogueira | 248/118.5 |
| 2005/0121562 | A1 | 6/2005 | Baumgardner | |
| 2006/0118679 | A1 | 6/2006 | Delgado | |
| 2008/0163801 | A1* | 7/2008 | Gamba et al. | 108/102 |
| 2008/0283479 | A1* | 11/2008 | Skille | 211/26.1 |
| 2009/0260647 | A1* | 10/2009 | Ionis et al. | 132/73.5 |
| 2014/0263878 | A1* | 9/2014 | Moy et al. | 248/118 |

* cited by examiner

WRIST REST APPARATUS

BACKGROUND OF THE INVENTION

1. Field of the Invention

This invention relates generally to grooming accessories and, more particularly, to a wrist support structure configured to support a person's wrist while receiving a manicure.

2. Description of the Prior Art

When receiving a manicure, it is often required to hold ones hands in a substantially fixed position for a extended length of time. By doing so, the manicurist is able to freely access and manipulate areas of the receiver's hands as needed. A general problem which is often created by this requirement, however, is that hands tend to stiffen when fixed in one position for an extended length of time. Indeed, it is well known that when a receiver of a manicure is required to hold and support her hands as required for the manicurist, the receiver's hands are prone to inadvertent movement and the receiver may become irritable, with either of which potentially hindering the manicure process.

As such, there remains a need for a wrist rest apparatus which would eliminate the need for a user to hold and support her hands while receiving a manicure. It would be helpful if such a wrist rest apparatus was structured so that when a user placed her wrist in it, her hands in a relaxed state would hang in a desired manner for a manicure to be performed. It would be additionally desirable for such a wrist rest apparatus to include a swivel mechanism to allow a user's hands to be rotated as desired by a manicurist.

The Applicant's invention described herein provides for an apparatus adapted to hold and support the wrist of a user, allowing the user's hand to naturally hang in a desired position for a manicure. The primary components of Applicant's wrist rest are a top console rotatably attached to a bottom console. When in operation, the wrist rest allows a user to place her hands in a desired elevated position for an extended period of time without requiring the user support her hands in the elevated position. As a result, many of the limitations of the prior art are removed.

SUMMARY OF THE INVENTION

A wrist rest apparatus for supporting a user's wrist while receiving a manicure and holding the user's hand in a desired manner for the manicure. The wrist rest apparatus comprises a top console rotatably attached to a bottom console. The top console and the bottom consoles are defined by a solid plastic, semi-circular member having centrally disposed apertures in corresponding locations. The top console, which provides a means for supporting a user's wrist, and the bottom console, which provides a base means for holding, are joined together through a swivel member which is configured to pass through and be retained in the apertures, providing an axis about which the top console can rotate relative to the bottom console. In this regard, the swivel member provides a means for providing for rotation. Rotating locking mechanisms are included to allow rotation to be limited, with the top console being fixed in a parallel orientation relative to the bottom console. As such, the locking mechanisms provide a locking means for restricting rotation.

It is an object of this invention to provide a wrist rest apparatus which would eliminate the need for a user to hold and support her hands while receiving a manicure.

It is another object of this invention to provide a wrist rest apparatus structured so that when a user placed her wrist in it, her hands in a relaxed state would hang in a desired manner for a manicure to be performed.

It is yet another object of this invention to provide a wrist rest apparatus which includes a swivel mechanism to allow a user's hands to be rotated as desired by a manicurist.

These and other objects will be apparent to one of skill in the art.

DETAILED DESCRIPTION OF THE INVENTION

Figure 1:
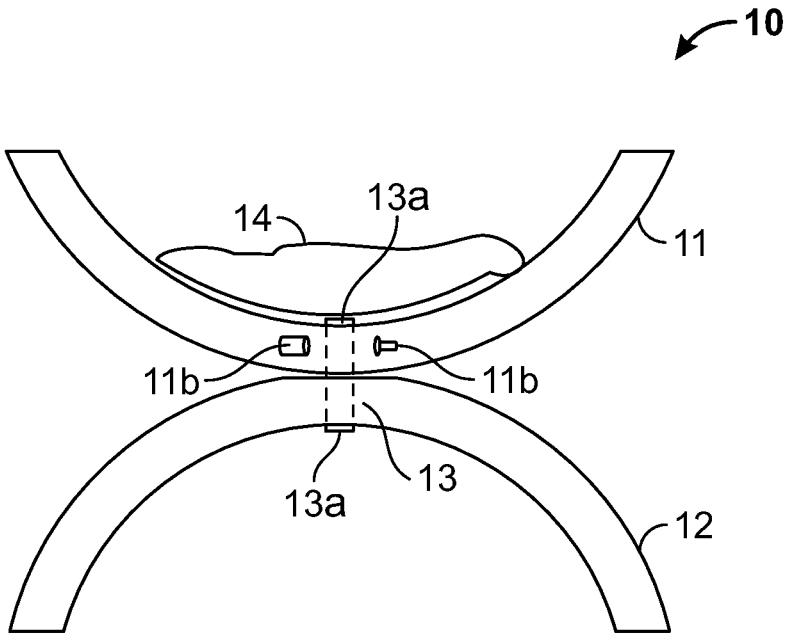
FIG. 1 is a front elevational view of a wrist rest apparatus built in accordance with the present invention having a wrist pad included and with the swivel member in phantom.

Referring now to the drawings and in particular FIGS. 1, 2, 3 and 4, a wrist rest apparatus 10 is shown having a top console 11 rotatably attached to a bottom console 12. The top console 11 is defined by a solid plastic, semi-circular member having a top swivel aperture 11*a* and rotating locking mechanisms 11*b*. The bottom console 12 is defined by a solid plastic, semi-circular member having a bottom swivel aperture 12*a*. In the preferred embodiment, the top console 11 and the bottom console 12 are identical in size. In other embodiments, the bottom console 12 is larger or smaller than the top console 11 to account for either user's with larger or smaller wrists, or user's who desire they wrists be supported at a higher or lower position.

Figure 2:
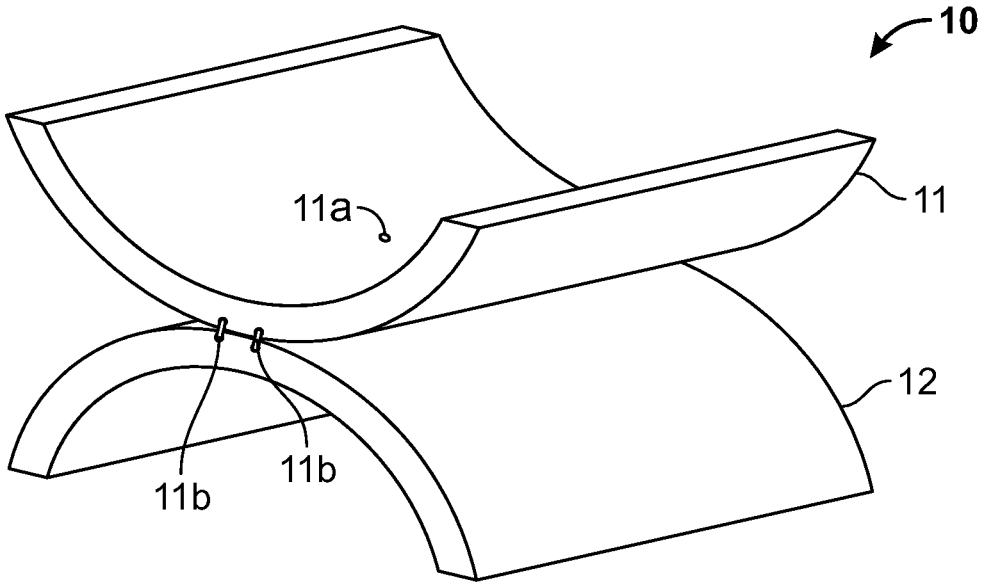
FIG. 2 is a front perspective view of a wrist rest apparatus built in accordance with the present invention.
Figure 3:
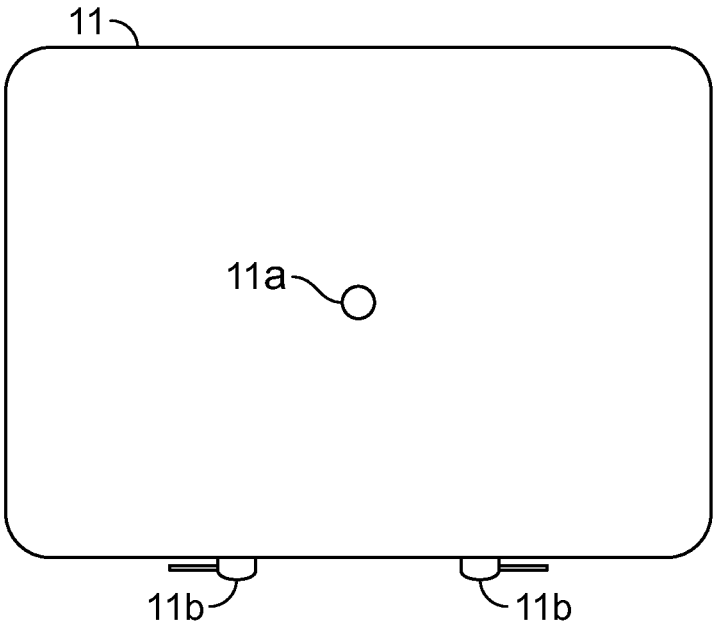
FIG. 3 is a top plan view of the top console of a wrist rest apparatus built in accordance with the present invention.
Figure 4:
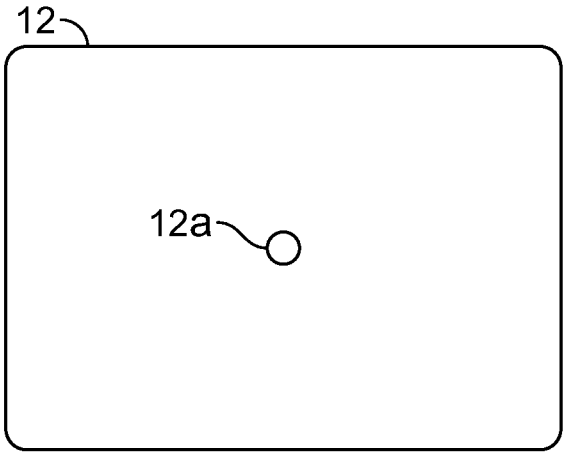
FIG. 4 is a bottom plan view of the bottom console of a wrist rest apparatus built in accordance with the present invention.

The top console 11 and the bottom console 12 are joined together through a swivel member 13 which is configured to pass through both the top swivel aperture 11*a* and the bottom swivel aperture 12*a* and be retained therein. To remain in place in both the top swivel aperture 11*a* and the bottom swivel aperture 12*a*, each end of the swivel member 13 has a locking member 13*a* removably attached thereto. The swivel member 13 provides an axis about which the top console 11 can rotate relative to the bottom console 12. The rotating locking mechanisms 11*b* can be placed in an unlocked position, as shown in FIG. 1, or placed in a locked position, as shown in FIG. 2. When the rotating locking mechanisms 11*b* are in the unlocked position, the top console 11 can rotate freely about the bottom console 12. When the rotating locking mechanisms 11*b* are in the locked position, the top console 11 can be fixed in a parallel orientation relative to the bottom console 12, as illustrated in FIGS. 1 and 2.

A wrist pad 14 is additionally included to provide a comfortable surface on which a user can place her wrists. In the preferred embodiment, the wrist pad is not attached to the surface of the top console 11. In other embodiments, the wrist pad 14 is removably attached to the surface of the top console 11. In yet other embodiments, the wrist pad 14 is permanently attached to the surface of the top console 11.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A wrist rest apparatus, comprising:

a top console defined by a first semi-circular member having two opposing top ends and a centrally disposed top aperture;

a bottom console integral with said top console and defined by a second semi-circular member having two opposing bottom ends and a centrally disposed bottom aperture, wherein said top console and bottom console are each shaped and together oriented such that the center of the arc of the top console contacts the center of the arc of the bottom console in a manner which causes the top aperture to align with the bottom aperture, the bottom ends form discrete legs suitable for supporting the bottom console and top console on a surface and the top ends extend away from the ends of the bottom console as a mirror image; and a swivel member disposed in the top aperture and the bottom aperture, wherein said swivel member provides an axis about which the top console can rotate relative to the bottom console.

2. The wrist rest apparatus of claim 1, additionally comprising at least one locking member disposed thereon.

3. The wrist rest apparatus of claim 2, wherein two locking members disposed thereon.

4. The wrist rest apparatus of claim 2, wherein said at least one locking member is disposed on said top console.

5. The wrist rest apparatus of claim 1, additionally comprising a wrist pad disposed on said top console.

* * * * *